United States Patent [19]

Ebnet

[11] Patent Number: 4,814,737

[45] Date of Patent: Mar. 21, 1989

[54] OVERLOAD RELAY

[75] Inventor: Friedrich Ebnet, Koefering, Fed. Rep. of Germany

[73] Assignee: Siemens Aktiengesellschaft, Berlin & Munich, Fed. Rep. of Germany

[21] Appl. No.: 72,118

[22] Filed: Jul. 10, 1987

[30] Foreign Application Priority Data

Jul. 23, 1986 [DE] Fed. Rep. of Germany ..... 8619694

[51] Int. Cl.[4] ..... H01H 61/00; H01H 71/16

[52] U.S. Cl. ..... 337/49; 337/47

[58] Field of Search ..... 337/45, 46, 47, 48, 337/49; 335/132

[56] References Cited

U.S. PATENT DOCUMENTS

| | | | |
|---|---|---|---|
| 2,678,981 | 5/1954 | Besag et al. | 337/49 |
| 3,265,831 | 8/1966 | Ramsey et al. | 337/48 |
| 3,638,158 | 1/1972 | Thorne | 337/49 |
| 4,087,770 | 5/1978 | Kuhn et al. | 335/132 |
| 4,096,465 | 6/1978 | Fryer | 337/49 |
| 4,528,539 | 7/1985 | Forsell et al. | 337/49 |

*Primary Examiner*—H. Broome

*Attorney, Agent, or Firm*—Kenyon & Kenyon

[57] ABSTRACT

The invention relates to an overload relay with input and output leads provided on opposite side surfaces of the housing as well as auxiliary switch terminals associated with the front side. The break contact terminal (17, 18) are provided here at the same height as the input terminals (3). The end is the fixed contacts for a contact bridge (13) which is held spring-loaded in a slide (10) which can be moved transversely to the front side. The spring (10) has a second contact bridge (19) which cooperates as a make contact with fixed contact parts (21, 22) which can be inserted into the housing (1), where the fixed contact parts (21, 22) are held in an additional block (23) which can be snapped into the housing (1) and in which make contact terminals (24, 25) end. In addition, a switch position indicator (26) and a test slide (30) are provided in the additional building block (23) and can be brought into engagement with the corresponding parts in the overload relay.

6 Claims, 6 Drawing Sheets

OVERLOAD RELAY

BACKGROUND OF THE INVENTION a. Field of Invention

This invention relates to an overload relay with input and output leads provided on opposite sides of the relay housing as well as auxiliary switch terminals associated with a front side thereof.

b. Description of the Prior Art

In a known overload relay of the above-mentioned kind (DE-GM No. 79 10 658) auxiliary contact input terminals for break and make contacts are arranged on the input side of an overload relay and the output leads for these auxiliary switch terminals are arranged on the output lead side of the overload relay. Since the relay is generally installed at a contactor or breaker, the auxiliary contact terminals are usually relatively inaccessible. In addition, the relay is generally equipped with two auxiliary contacts a break contact and a make contact, although the break contact would be sufficient for many cases.

SUMMARY OF THE INVENTION

It is therefore an object of the present invention to improve the overload relay of the above-mentioned type with respect to the accesibility of the auxiliary contact terminals and also of the equipment of the relay with auxiliary contacts in general. This is achieved in a simple manner by providing break contact terminals which are arranged at the same height as the input-lead terminals and the fixed contacts and form the fixed contact for a contact bridge. The bridge is held, spring-loaded in a slide, movable transversely to the front side. The slide holds a second contact bridge which cooperates as a make contact with fixed-parts of the auxiliary contact which can be inserted into the housing. The fixed contact parts are held in an additional block which is secured to the housing and which also holds the make contact terminals. A simple arrangement of fixed contacts and the contact bridge is obtained if the second contact bridge is held behind the first one in the slide, pointing away from the front side. A contact position indicator for the overload relay can be provided without further cost. The slide has an extension which can be coupled to the contact position indicator provided in the additional block. Simple and inexpensive production of this contact position indicator is obtained if the contact position indicator consists of a one-piece angular plastic lever with a molded-on plastic spring. The overload relay can be easily tested if interlocking means of the slide can be decoupled by a test slide movably guided in the supplemental building blocks. A simple engagement of the additional block with the overload relay can be realized if the additional block is installed instead of a lateral housing cover.

BRIEF DESCRIPTION OF THE DRAWINGS

An embodiment example according to the invention will be described with reference to the drawings, wherein.

DESCRIPTION OF THE PREFERRED EMBODIMENT

Figure 1:
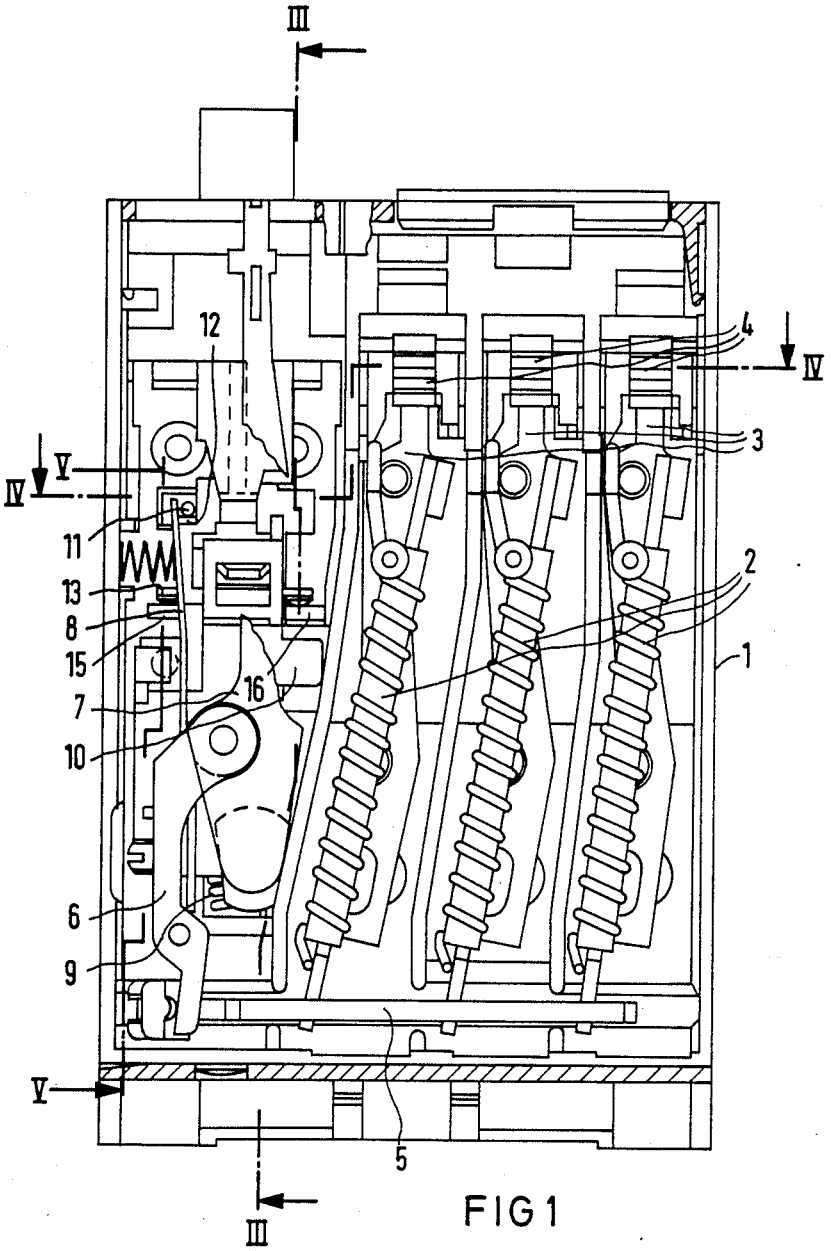
FIG. 1 shows a side view onto the overload relay constructed in accordance with the invention with one side wall corresponding to the input side removed.
Figure 2:
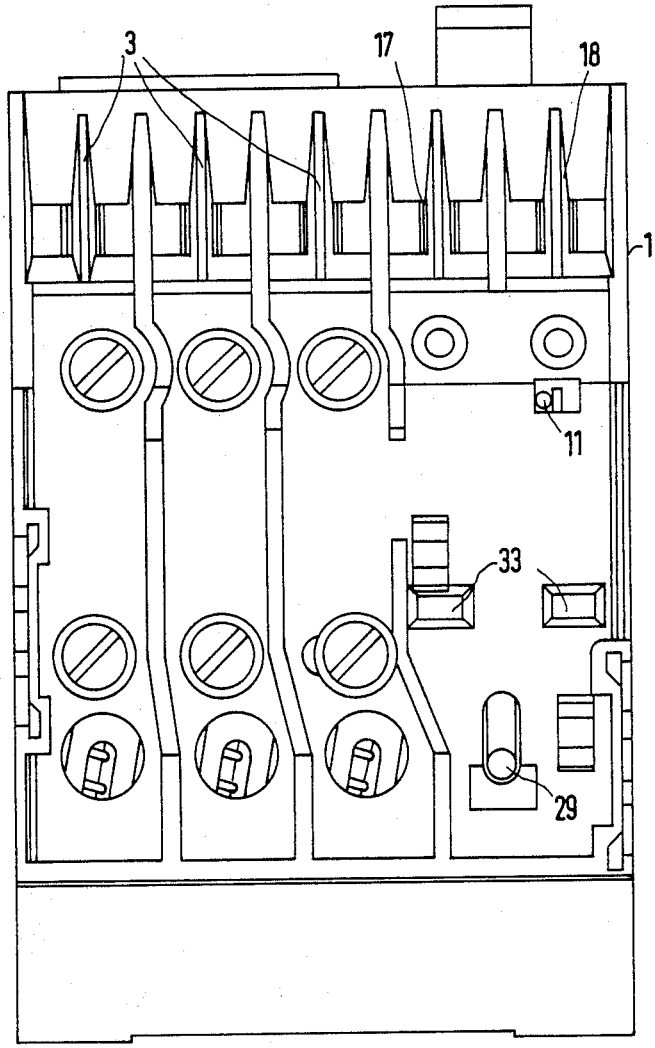
FIG. 2 shows a side view of the output side opposite the view of FIG. 1, and with the cover removed, and with an additional building block.
Figure 3:
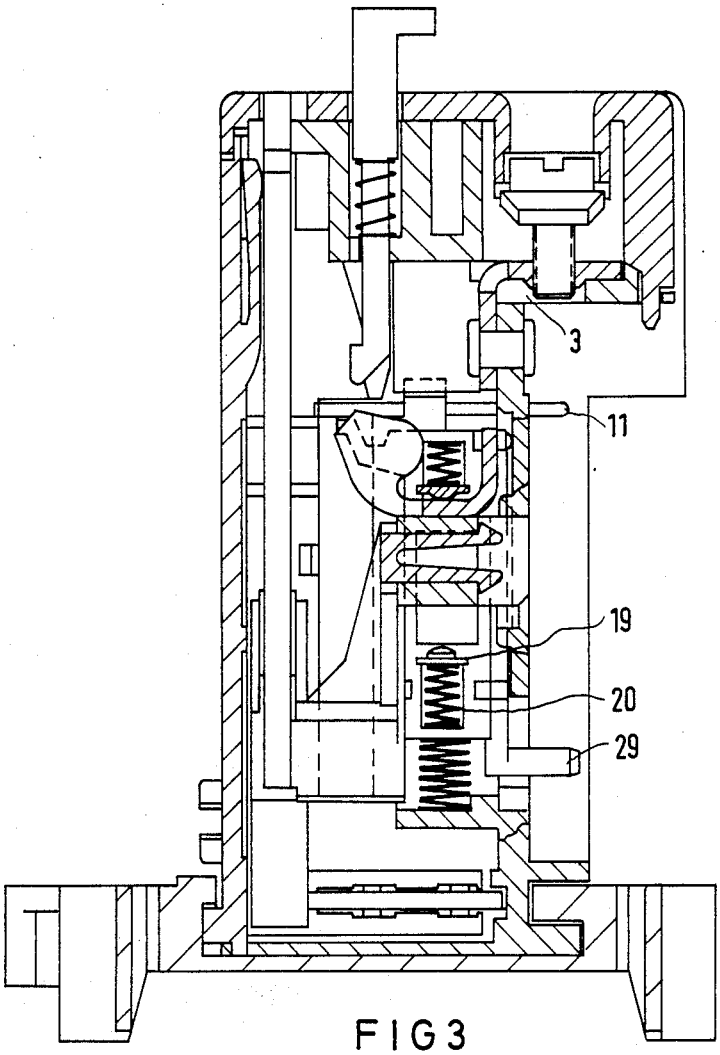
FIG. 3 shows a cross-sectional view of the relay taken along line III—III in FIG. 1.
Figure 4:
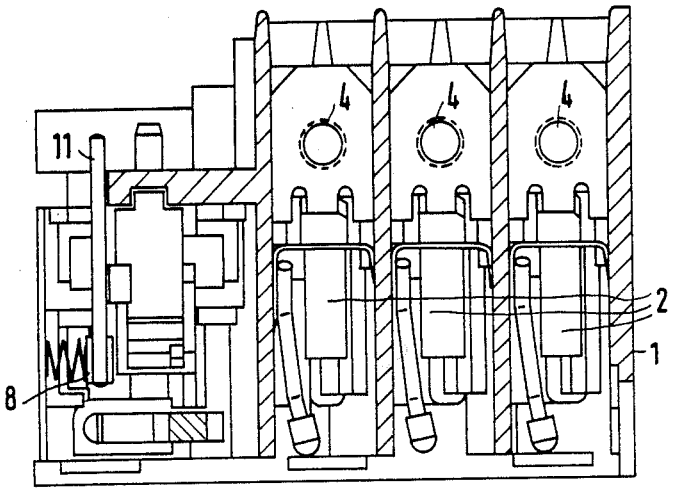
FIG. 4 shows a cross-sectional view taken along line IV—IV of FIG. 1.
Figure 5:
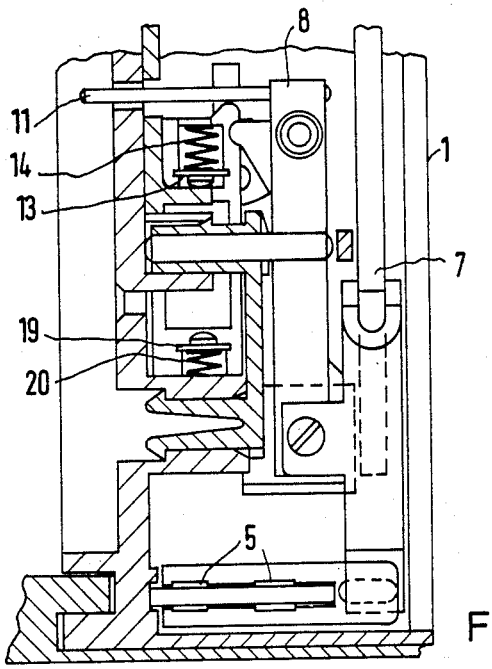
FIG. 5 shows a cross-sectional view taken along line V—V of FIG. 1.
Figure 6:
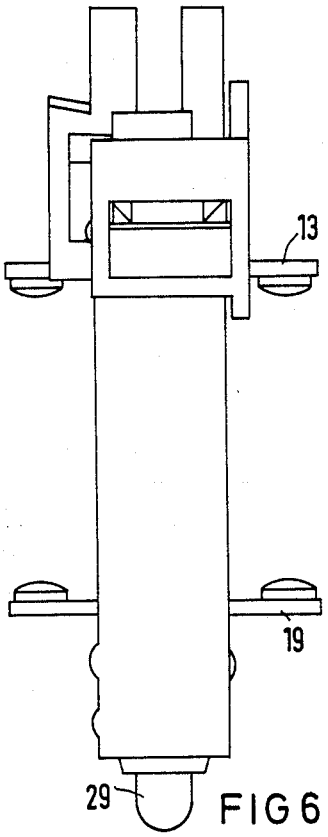
FIGS. 6 and 7 show a front view and a side view respectively of the slide movably arranged in the overload relay.
Figure 7:
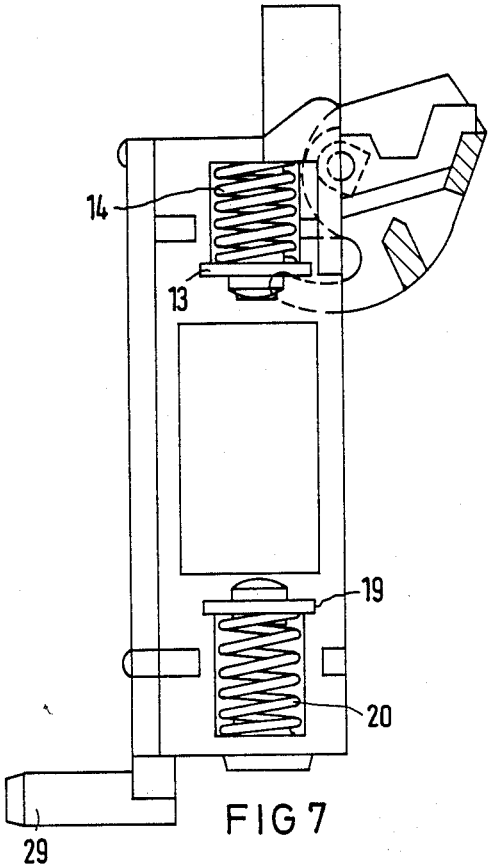
Figure 8:
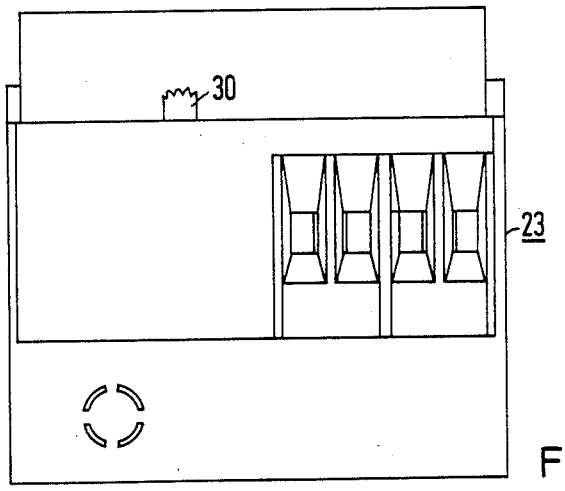
FIGS. 8, 9 and 10 show a front view, back view and top view respectively of the additional building block.
Figure 10:
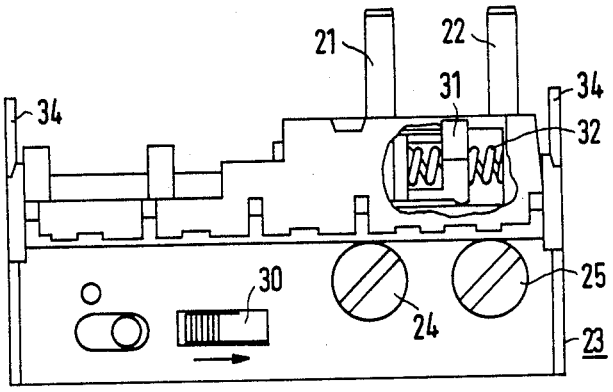
Figure 11:
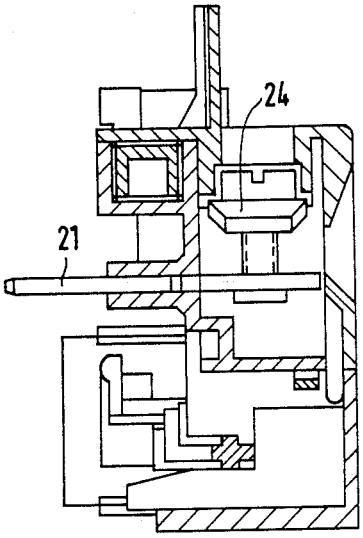
FIG. 11 shows a cross-sectional view taken along line XI—XI of FIG. 9.
Figure 9:
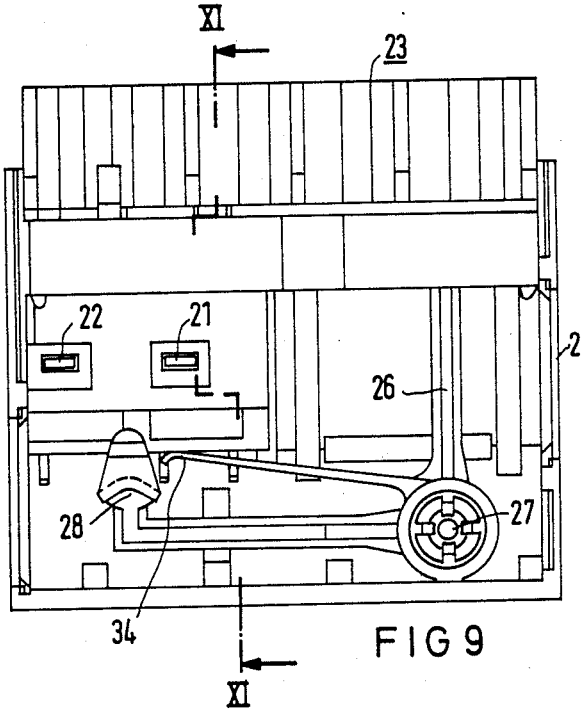

An overload relay constructed in accordance with this invention consists of a housing 1, in which the bimetallic strips 2 are secured by input terminals 3. The current-carrying winding of the bimetallic strips 2 terminate on the output leads 4. The bimetallic strips 2 are brought into functional connection with the slide 10 which is biased by a spring 9 through a differential slide 5, a transmission lever, an adjusting lever 7 and a temperature-compensating strip 8. The temperature compensating strip 8 has a pin 11 which extends behind an undercut 12 of the slide 10 so that the slide is positioned in FIG. 1. In this position, a contact bridge 13 which is held spring-loaded in the slide by the contact pressure spring 14 comes into contact with the fixed contact parts 15, 16 which are connected terminals 17, 18. As is shown in FIG. 2, the terminals 17, 18 lie in one plane with the input terminals 3. In the slide 10 is held a further contact bridge 19 spring-loaded by the spring 20 which cooperates with the fixed contact parts 21, 22 which are held in the additional block 23 as a make contact. The fixed contact parts 21, 22 are connected to the terminals 24, 25. In the additional block 23 is furthermore pivoted on the mandrel 27 and an angle lever 26 which serves as an indicator. In the assembled condition, this angle lever comes into engagement with the recess 28 with the extension 29 of the slide 10. By a test slide 30, the pin 11 is in engagement via the extension 31 for decoupling the interlocking means and thereby to test the contact device. The test slide 30 is loaded with a resetting force via the spring 32. When the additional block 23 is installed, the fixed contact parts 21, 22 engage the recesses 33 of the side visible in FIG. 2 and thus form the fixed contact parts for the contact bridge 19. The recess 28 comes into engagement with the extension 29 and the pin 11 rests against the extension 31 of the test slide 30. The additional block 23 is snapped-in via detent arms 34 with the housing 1 of the overcurrent relay. By mounting the additional block, an additional auxiliary switch can therefore be mounted as a make contact. In addition, a means for testing and an indication of the switch position are provided.

Obviously numerous modifications may be made to the invention without departing from its scope as defined in the attached claim.

What is claimed is:

1. An overload relay comprising:

a housing with a front surface, a first and a second side surface, said first side surface being disposed opposite said second side surface;

an input terminal (3) disposed adjacent to said first side surface at a preselected height;

a slide (10) disposed within said housing and movable transversally to said front surface;

a first contact bridge (13) being held by said slide and having fixed break contact terminals (17, 18), said break contact terminals being disposed at said preselected height;

an auxiliary block (23) removably attached to said housing and having make contact terminals (24, 25), auxiliary leads connected to said make contact terminals, and fixed contact parts (21, 22);

current carrying bimetallic means (2) connected to said slide (10) for moving said slide; and a second contact bridge (13) held by said slide, said second contact bridge cooperating with said fixed contact parts (21, 22) to form an auxiliary make contact.

2. The overload relay according to claim 1 said second contact bridge (19) is held in said slide (10) behind said first contact bridge (13), pointing away from said front surface.

3. The overload relay according to claim 1 wherein said slide (10) has an extension (29) which is coupled to a switch position indicator (26) provided in said auxiliary block (23).

4. The overload relay according to claim 3, wherein said switch position indicator consists of a one-piece plastic angle lever (26) with a molded-on plastic spring (34).

5. The overload relay according to claim 4 wherein said slide (10) includes interlocking means (11, 12) and wherein said relay further comprises a test slide (30) movably guided in said auxiliary block for disengaging said interlocking means.

6. The overload relay according to claim 1 said auixilary block is installed instead of a lateral housing cover.

* * * * *